United States Patent [19]

Oshima et al.

[11] Patent Number: 4,993,006

[45] Date of Patent: Feb. 12, 1991

[54] DEVICE FOR TURNING DECORATION FOR TIMEPIECE

[75] Inventors: Kenji Oshima; Hiroshi Yamazaki; Shigeru Shimozono; Shinya Tamura, all of Tokyo, Japan

[73] Assignee: Seikosha Co., Ltd., Japan

[21] Appl. No.: 438,711

[22] Filed: Nov. 17, 1989

[30] Foreign Application Priority Data

Nov. 24, 1988 [JP] Japan ..... 63-296982

[51] Int. Cl.[5] ..... G04B 19/16; G04B 21/00

[52] U.S. Cl. ..... 368/231; 368/272; 368/223

[58] Field of Search ..... 368/223, 242, 15–20, 368/272, 273

[56] References Cited

U.S. PATENT DOCUMENTS

| | | | |
|---|---|---|---|
| 384,737 | 6/1888 | Bickford | 368/231 |
| 401,697 | 4/1889 | Ethridge | 368/231 |
| 403,525 | 5/1889 | Ethridge | 368/231 |

*Primary Examiner*—Bernard Roskoski

*Attorney, Agent, or Firm*—Bruce L. Adams; Van C. Wilks

[57] ABSTRACT

A timepiece having a housing and at least one decorative element mounted for rotation relative to the housing. The mounting comprises a rotary member supporting the decorative element and rotatably mounted on a shaft connected to the housing, a stationary gear mounted on the shaft, a drive motor mounted on the rotary member for rotation therewith, and a pinion for engaging the drive motor with the stationary gear to effect rotation of the decorative element.

6 Claims, 12 Drawing Sheets

1

DEVICE FOR TURNING DECORATION FOR TIMEPIECE

DETAILED DESCRIPTION OF THE INVENTION

Industrial Field of Utilization

This invention relates to a device for turning a decoration for a gimmicky clock, and more particularly to a small turning device for driving a rotary member provided with a decoration such as dolls.

BACKGROUND OF THE INVENTION

Prior Art

Typical gimmicky clocks for domestic use in the prior art are a cuckoo clock featured in that a door opens and a cuckoo appears to sign at the hour, and a similar clock featured in that a doll on a terrace rotates in harmony with a melody of a music box after a door opens and a cuckoo sings at the hour. In such clocks, rotary gears and stationary gears are used to cause the rotational motion. On the other hand, large gimmicky clocks use turning devices comprising air cylinders, air pressure control units, limit switches, etc. In either case, such a turning device is arranged outside a moving section.

Problems to be Solved

In such clocks in the prior art, the whole turning device is large compared with that of an actually moving section so that the clocks take up more space. And a structure for covering a turning device disposed outside a moving section is required. Since a storage space for a cuckoo or the like is large, it is difficult to dispose a plurality of moving decorations close to one another inside one clock. The clock employing the air unit or the like becomes complicated in configuration and grows in cost.

Therefore, it is an object of the present invention to provide at a low cost a turning device of which the whole can be made small in size compared with a rotating section and which a plurality of rotating blocks can be disposed in one clock.

It is another object of the present invention to prevent a rotary member from bounding when the same stops rotating.

It is still another object of the present invention to prevent teeth from being subject to a damage or collapse even if some external force is applied such that a rotary member is forced to rotate over the extent of a given angle and thus an unreasonable force is imposed on a gear.

SUMMARY OF THE INVENTION

Means for Solving the Problems

To achieve the foregoing objects, a turning device in the present invention comprises a rotary member provided with a decoration, a stationary gear disposed concentrically to a center shaft of rotation of the rotary member, a driving motor carried on the rotary member for rotating the latter, and a gear mounted on the rotary member which includes a pinion being in gear with the stationary gear and is engaged with a drive gear of the driving motor.

The present invention, further has a regulation means for restricting an angle of rotation of the rotary member. This regulation means comprises two engaging portions provided on the rotary member correspondingly to the angle of the rotation; a stopper disposed fixedly and projectingly, and a damper fitted frictionally-shiftably on the stopper and with which each of the engaging portions can contact resiliently.

The gear in the present invention is supported rotatably on a resiliently-displaceable shaft, and the pinion is disposed on the side of a distal end of the shaft.

Operation

In the turning device of the foregoing structure, when the driving motor on the rotary member starts, the gear rotates in response to the rotation of the drive gear, the pinion rolls around the stationary gear, and thus the rotary member rotates with the decoration and the driving motor.

Even after the rotary member has rotated with a given angle of rotation and a driving signal to the driving motor has terminate, the rotary member rotates further due to the inertia. At the same time, one engaging portion of the rotary member resiliently contacts with the damper to push it. The damper shifts against a friction with the stopper, and finally the damper compresses, whereby a turning force is absorbed completely.

If some external force causes an unreasonable force to act on the rotary member, the resiliently-displaceable shaft is displaced to release the engagement of the pinion with the stationary gear.

BRIEF DESCRIPTION OF THE DRAWINGS

The drawings show an embodiment of the present invention, in which.

DETAILED DESCRIPTION OF THE INVENTION

Embodiment

An embodiment of the present invention will now be described with reference to the drawings.

Figure 1:
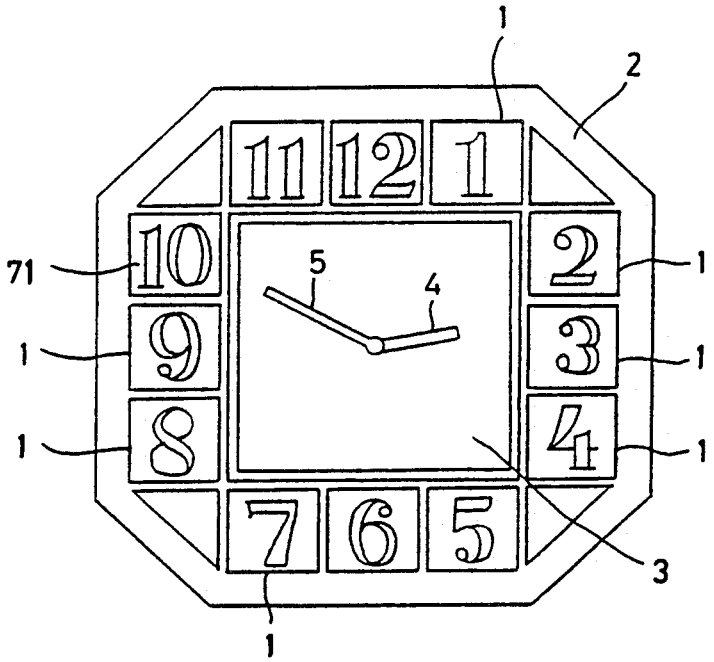
FIGS. 1 and 2 are front view of a gimmicky clock in reduced scale.
Figure 2:
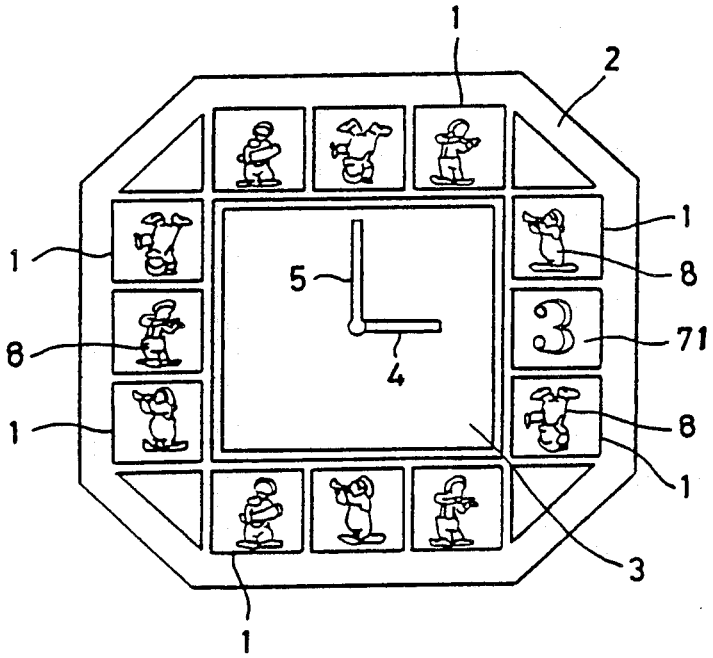

FIGS. 1 and 2 are front views of a gimmicky clock for domestic use, to which the present invention is applied. Numerals indicative of the hours between 1 to 12 are expressed one by one on twelve rotary blocks 1 described hereinafter. Each rotary block 1 is located on a case 2 at each position such that the numeral expressed on an hour indicating surface 71, of each rotary block accords with the hour indicating numeral of the clock which is implied by each position. An hour hand 4 and a minute hand 5 are positioned in front of a dial 3, and rotated by a timepiece movement (not shown) secured to the back of the dial 3.

Figure 3:
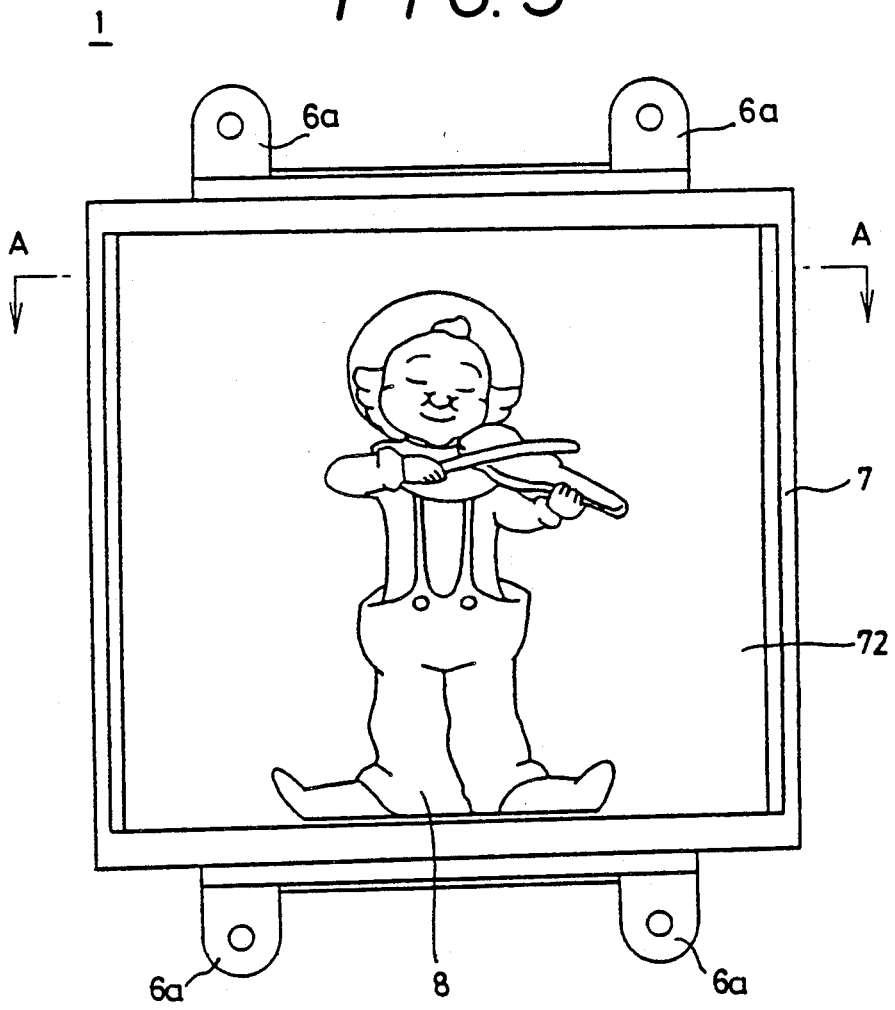
FIG. 3 is a front view of a rotary block with a decoration presented in front.
Figure 4:
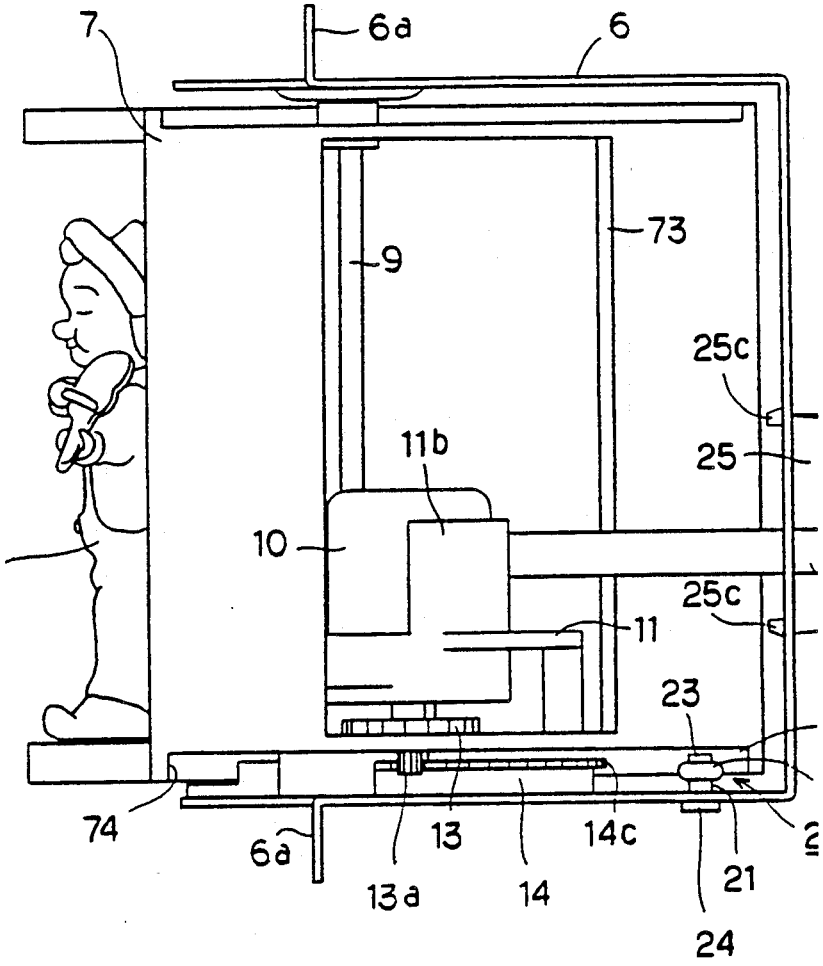
FIG. 4 is a right side view of the rotary block with a decoration presented in front.
Figure 5:
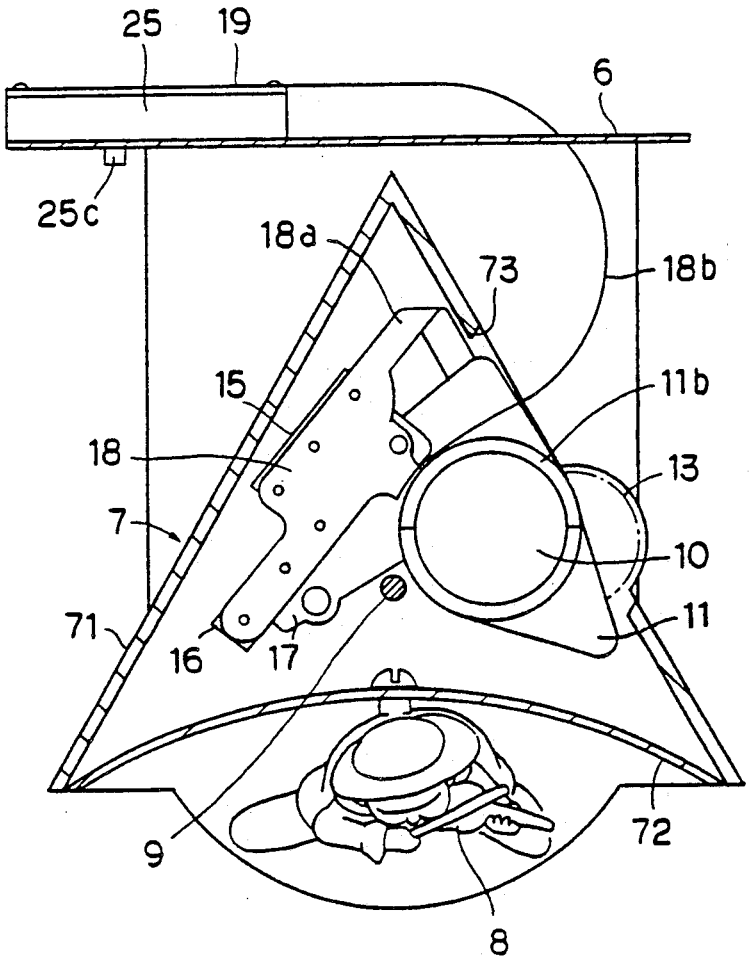
FIG. 5 is a sectional view taken along line A—A of FIG. 3.

As shown in FIGS. 3 to 5, the rotary block 1 is configured so that a rotary member 7 is rotatably supported by an install member 6 which substantially has an U-shaped section, and secured to the case 2 by means of installation members 6*a* . . . of the install member 6. As shown in FIG. 5, the rotary member 7 is substantially triangular in the plan view. One surface of the rotary member 7 is plane, defining the hour indicating surface 71 on which the hour indicating numeral is expressed. Another surface defines a circular arc surface 72 on which a decoration 8 in the form of a doll such as a clown is provided. The other surface has an opening 73. The rotary member 7 is rotatably supported on the install member 6 by a center shaft 9 passing vertically through a central portion of the rotary member.

Figure 6:
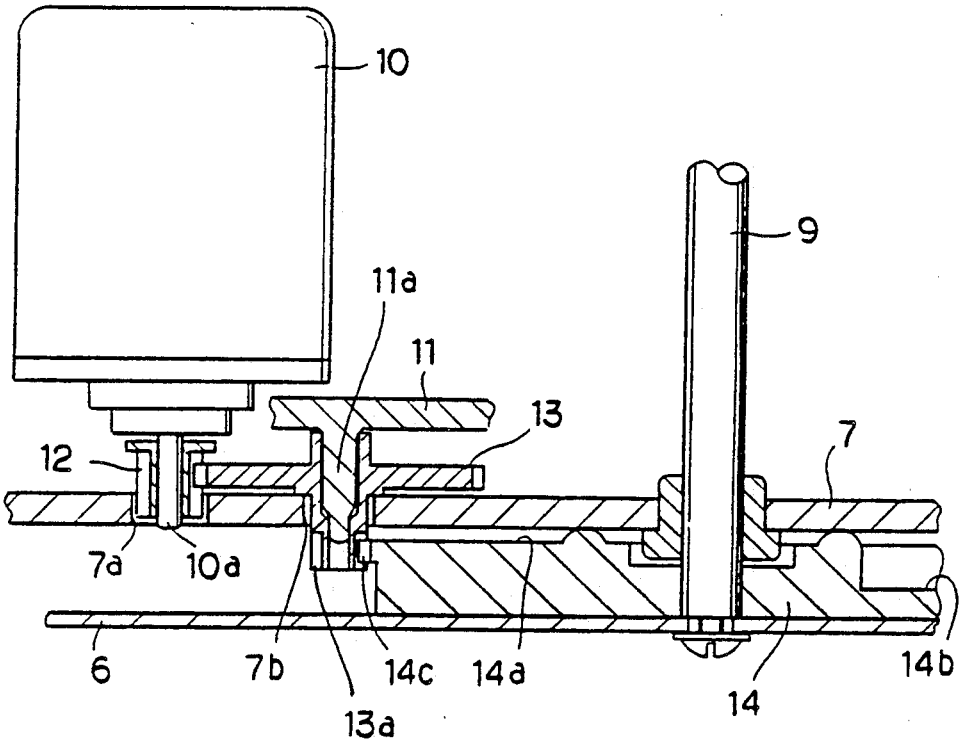
FIG. 6 is an enlarged sectional view showing an important portion of a turning device for a rotary member.

As shown in FIGS. 5 and 6, a turning device of the rotary member 7 is arranged inside the rotary member 7 itself. A driving motor 10 of the rotary member 7 is attached via a supporting plate 11 on the rotary member 7. A shaft 10*a* of the driving motor 10 has a drive gear 12 secured thereon, a lower end of this drive gear 12 being loosely fitted in an opening 7*a* formed in the bottom of the rotary member 7. The supporting plate 11 has a resiliently-displaceable shaft 11*a* extending vertically, and a gear 13 is rotatably fitted on this shaft. This gear 13 is engaged with the drive gear 12 and has a pinion 13*a* formed integrally therewith. The pinion 13*a* is located on the side of a distal end of the shaft 11*a*. The bottom of the rotary member 7 has an opening 7*b* through which the pinion 13*a* can pass and project. There is a sufficient space between the inner surface of the opening 7*b* and a shaft portion of the gear 13.

Figure 7:
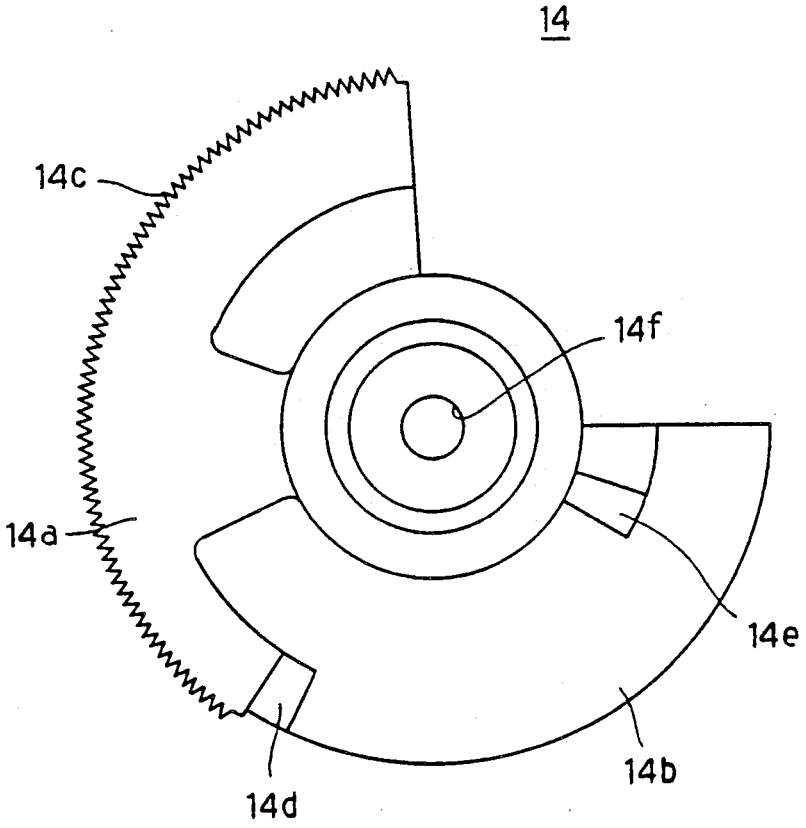
FIG. 7 is an enlarged plane view of a stationary gear.
Figure 8:
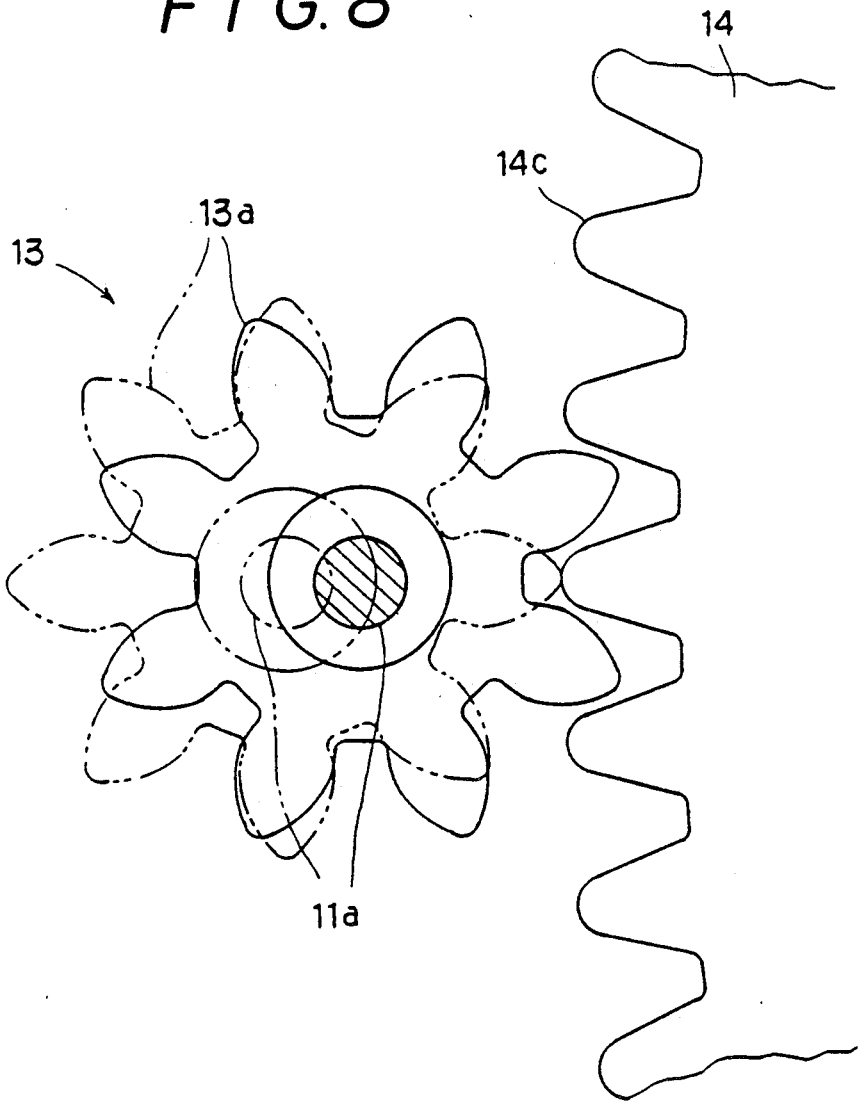
FIG. 8 is an enlarged plane view explanatory of the engagement and disengagement of the stationary gear with a pinion.

The install member 6 has a stationary gear 14 on the bottom thereof concentrically to the center shaft 9. As shown in FIG. 7, this stationary gear 14 has a center hole 14*f* in the center thereof through which the center shaft 9 passes, and includes a thin portion 14*b* and a thick portion 14*a* having a teeth portion 14*c*. This teeth portion 14*c* is engaged with the pinion 13*a*. Since the pinion 13*a* is supported by the resiliently-displaceable shaft 11*a* as described above, when an unreasonable force is applied, the shaft 11*a* displaces within the space of the opening 7*b* as shown in FIG. 8 so that the engagement of the two components can be released. To facilitate the release of the engagement, teeth of the teeth portion 14*c* and the pinion 13*a* are made circular at the end thereof.

Figure 9:
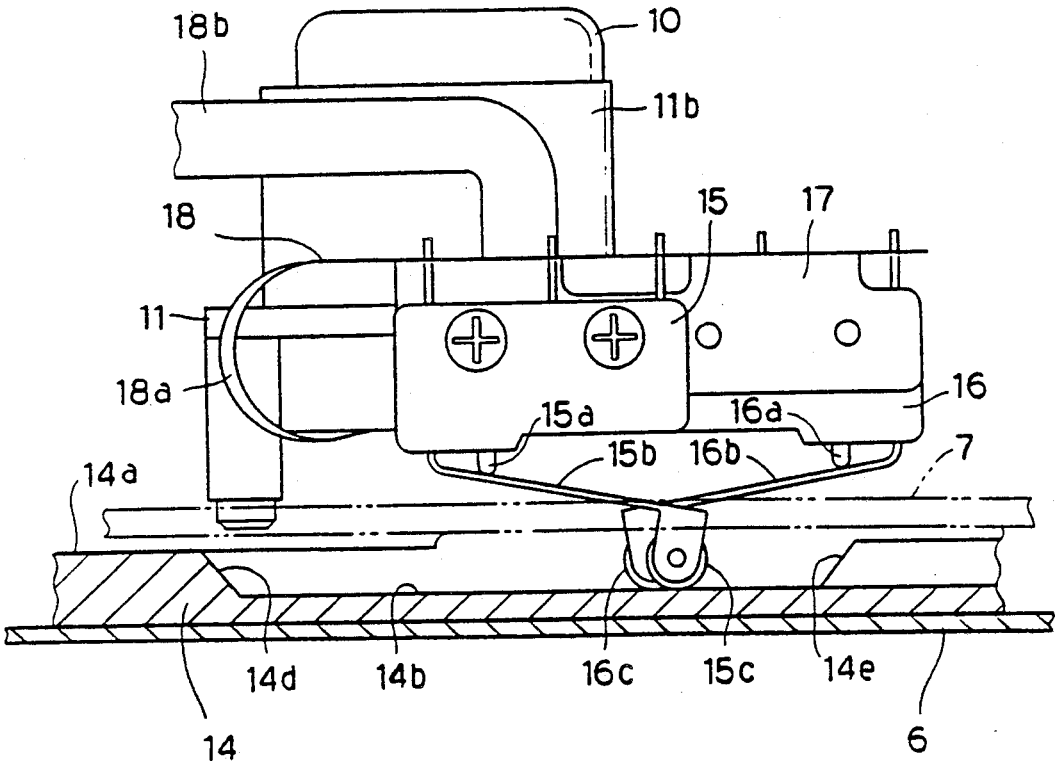
FIG. 9 is an enlarged explanatory front view showing an important portion of a mechanism for actuation of switches.
Figure 10:
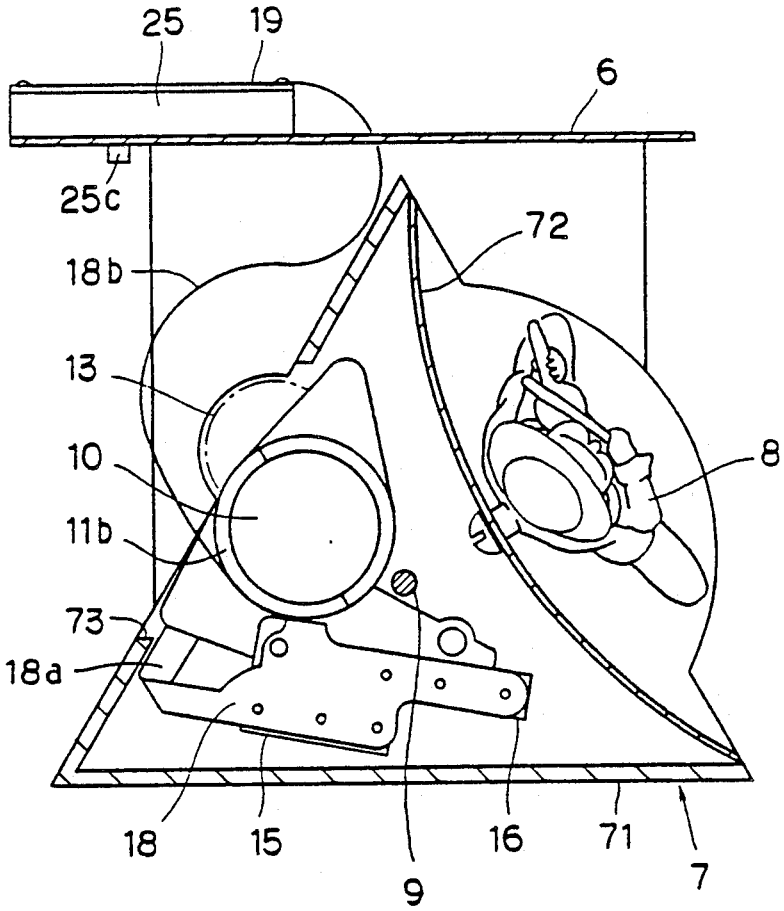
FIG. 10 is a sectional view of the rotary block with an hour indicating surface presented in front.

As shown in FIGS. 9 and 10, the supporting plate 11 has microswitches 15 and 16 for control of the driving motor 10 attached thereto via an install plate 17. A flexible cable 18 is secured to the upper surface of this install plate 17. The flexible cable 18 is connected with the both switches 15 and 16. Integrally-elongated portions 18*a* and 18*b* connect the driving motor 10 with a circuit board 19 described hereinafter. And the portion 18*b* connects the switches 15 and 16 with the circuit board 19.

A mechanism for actuating the switches 15 and 16 will be described.

As shown in FIG. 9, the switches 15, 16 have respectively operating members 15*a* and 16*a* retractably projecting from their respective bottom surfaces. These operating members are retracted, in response to swinging of the operating springs 15*b* and 16*b* which are swingably provided to the bottom surfaces of the switches, so as to actuate the switches. The operating springs 15*b* and 16*b* have on their respective distal ends have rollers 15*c* and 16*c* projecting downward through an opening (not shown) in the bottom surface of the rotary member 7. These rollers are adapted to roll over the thin portion 14*b* of the stationary gear 14 within a given angle of rotation. The travel loci of the two rollers are defined as circumferences whose radii from the center of the stationary gear 14 differ from each other. That is, the roller 15*c* has a large-diameter circumference as its travel locus and the roller 16*c* has a small-diameter circumference. The thin portion 14*b* has an inclined surface at one end (the left end in FIG. 9) on the large-diameter travel locus which defines a cam surface 14*d*, and another inclined surface at the other end (the right end in FIG. 9) on the small-diameter travel locus which defines another cam surface 14*e* whose direction of inclination is opposite to that of the cam surface 14*d*. Therefore, when the rotary member 7 rotates a given angle of rotation, one roller rolls upward one cam surface, so that one operating spring swings to retract one operating member, thereby turning off one switch.

A regulation means 20 of restricting the angle of rotation of the rotary member 7 will be described.

Figure 11:
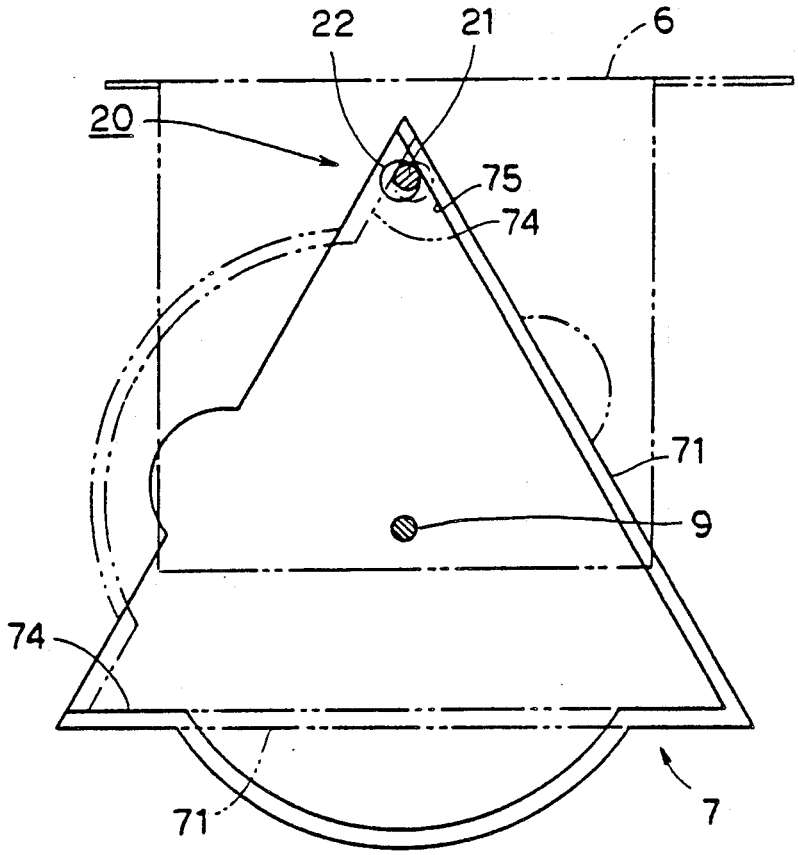
FIG. 11 is a bottom view of a regulation means.
Figure 12:
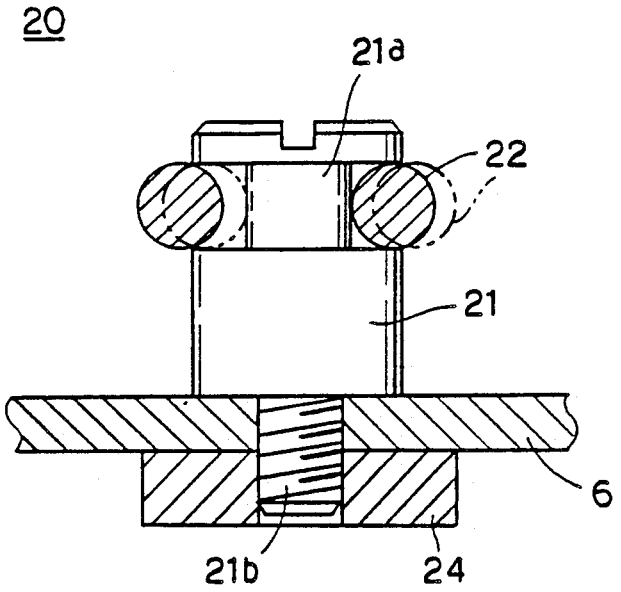
FIG. 12 is an enlarged sectional view of the regulation means.

As shown in FIG. 11 and 12, the rotary member 7 has on its bottom two engaging portions 74 and 75 which correspond to the angle of rotation (120 degrees) of the rotary member 7. The install member 6 has a stationary stopper 21 projecting therefrom. This stopper 21 has a ring-like damper 22 fitted on a neck portion 21*a*. The damper 22 is prevented from coming off by a screw 23. The damper 22 is dimensioned so that its inner diameter is larger than the diameter of the neck portion 21*a* but smaller than the diameter of the stopper 21. And its thickness is larger than the width of the neck portion 21*a*. The damper 22 is made of an elastic material such as rubber. Thus, the damper 22 can shift frictionally in relation to the stopper 21. The engaging portions 74 and 75 of the rotary member 7 can resiliently contact with the damper 22 in opposite directions. To secure the stopper 21 to the install member 6, the stopper 21 has an installation thread 21*b* formed in a lower portion thereof, and a nut 24 is screwed to the installation thread on the under side of the install member 6.

A unit of supplying power to the driving motor 10 will be described.

Figure 13:
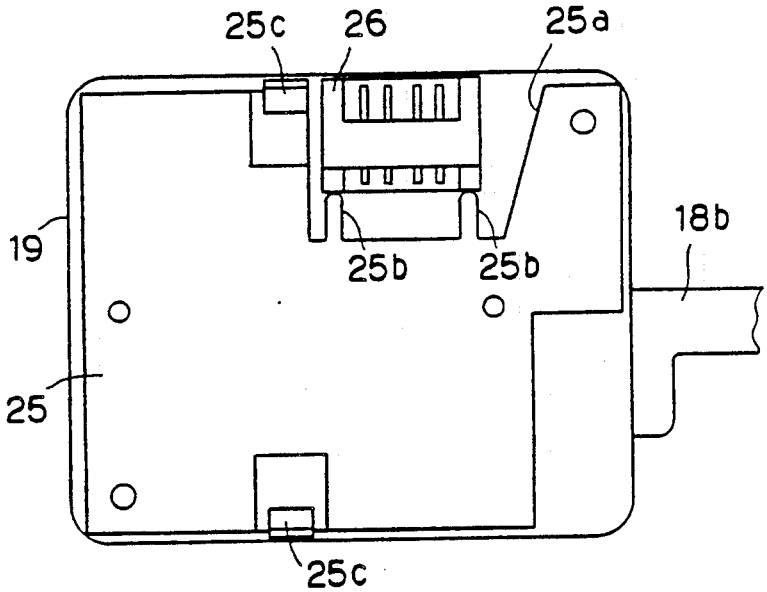
FIG. 13 is an enlarged back view of a portion of a power supply unit for a driving motor.
Figure 14:
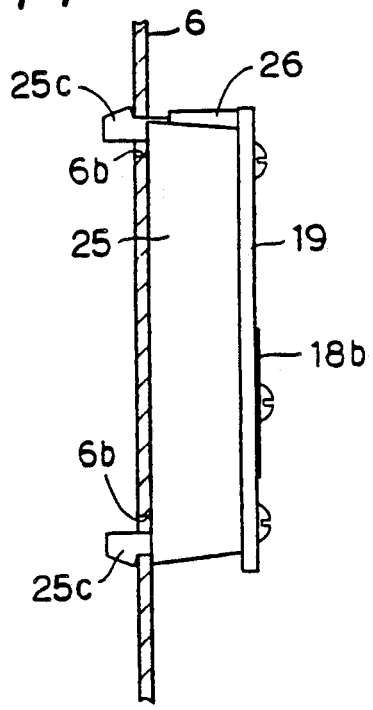
FIG. 14 is a right side view of the above.

As shown in FIG. 13 and 14, a receiving plate 25 is secured to the back surface of the circuit board 19 connected with the portion 18*b* of the flexible cable 18. The circuit board 19 is secured via this receiving plate 25 to the back surface of the install member 6. The receiving plate 25 has a recess portion 25*a* in which a connector 26 for connection of the circuit board 19 with a control circuit (not shown) can be accommodated. The bottom further of the recess portion 25*a* has protrusions 25*b* for supporting a side surface of the connecter 26. The receiving plate 25 surface has a plurality of resilient pawls 25*c* projecting backward which are adapted to secure the receiving plate 25 to the install member 6. The install member 6 has engaging holes 6b in which the resilient pawls 25c are engageable through their resilient deformation.

As described above, the driving motor 10 is carried on the rotary member 7, so as to change its position together with the rotary member 7. Therefore, the portion 18b of the flexible cable 18 for connection of the driving motor 10 with the circuit board 19 is liable to touch the peripheral surface of the driving motor 10, the corners of the rotary member 7 and the install member 6 lying on the path of the portion 18b of the flexible cable 18, and the like. To reduce slide frictions between those components and the portion 18b of the flexible cable 18, as shown in FIGS. 4, 5, 9 and 10, a protective wall 11b is formed integrally with the supporting plate 11 around the driving motor 10. Therefore, the portion 18b of the flexible cable 18 never slides directly on the peripheral wall of the motor 10, causing no slide friction with metal; thus, a service life of the flexible cable can be prolonged effectively.

Because of the foregoing structure, while the gimmicky clock shown in FIGS. 1 and 2 is indicating time with the rotary member 7 of each rotary block 1 presenting its hour indicating surface 71 in front, when the hour (e.g. three o'clock) is reached, the individual rotary members 7 are rotated at random in harmony with a melody, so that the decorations 8 are presented in front as shown in FIG. 2. Then, an electronic time signal corresponding to the count of a current hour (three o'clock) is sounded, the rotary members are successively rotated starting with one next to that corresponding to the current hour, and finally, each initial hour indicating surface 21 is presented in front.

The rotational operation as above of the rotary member 7 will be described in more detail.

Where the rotary member 7 remains stationary with its hour indicating surface 71 presented in front, the engaging portion 74 is in resilient contact with the damper 22 as illustrated by the chain line in FIG. 11, the one roller 16c having ridden on the cam surface 14e lies on the thick portion 14a and the other roller 15c lies on the thin portion 14b.

When a driving signal is supplied through the flexible cable 18 to the driving motor 10, the driving motor 10 starts to rotate the drive gear 12, so that the gear 13 and the pinion 13a are rotated. Since the pinion 13a is meshed with the teeth portion 14c of the stationary gear 14, it moves along the teeth portion while rotating. As a result, the rotary member 7 is rotated clockwise from the position where the hour indicating surface 71 is presented in front as shown in FIG. 10. During this rotating of the rotary member 7, the both roller 15c and 16c are rolling over the thin portion 14b. When the rotary member 7 is rotated further so that the roller 15c rides on the cam surface 14d, the supplying of the driving signal is terminated to stop the driving motor 10. Although the driving motor 10 and the rotary member 7 try to continue rotation due to their inertia, as illustrated by the solid line in FIG. 11, the engaging portion 75 comes into resilient contact with the damper 22 in the opposite direction to push the damper, so that the damper shifts frictionally in relation to the stopper 21 while absorbing a turning force resulting from the inertia. Finally, the damper 22 completely absorbs the turning force through its elastic deformation, whereby the rotary member 7 can be stopped smoothly without bounding. At this stage, the decoration 8 is presented in front.

During the foregoing rotation of the rotary member 7, the driving motor 10 also moves from the position shown in FIG. 10 to the position shown in FIG. 5. The portion 18b of the flexible cable 18 maintains its gentle curved shape and contacts only with the peripheral surface of the protective wall 11b even at the position shown in FIG. 10; thus, it never contacts with the peripheral surface of the driving motor 10.

When returning the rotary member 7 to the state wherein the initial hour indicating surface 71 is presented in front, a driving signal for reverse rotation is supplied to the driving motor 10, whereby a series of operations identical with that described above is performed.

If some external force is applied to the rotary member 7 to cause its rotation forcibly, the teeth portion 14a and the pinion 13a collide because the gear 14 engaged with the pinion 13a is fixed, so that the teeth portion 14a may be damaged. In the embodiment, however, the shaft 11a resiliently displaces to the chain line position in response to a force acting thereon as shown in FIG. 8, so that the engagement of the pinion 13a with the teeth portion 14c is released, thereby preventing such damage.

It should be noted that the rotary member may has a cylindrical or hexagonal shape as well as triangular.

Effects

According to the present invention of the foregoing structure, most of the components demanding spaces of the turning device, such as driving motor and gear, are carried on the rotary member having the decoration, and the stationary gear only is disposed outside the rotary member. Therefore, the whole can be reduced in size compared with the rotating section, the plurality of the rotary blocks can be arranged in one clock, and the clock can be produced at a low cost.

The regulation means for the angle of rotation is provided such that the damper is frictionally shiftable in relation to the stopper; thus, a shock resulting from restricting the angle of rotation can be efficiently absorbed, thereby preventing the rotary member from bounding when stopping.

Further, even of some external force is applied to the rotary member to rotate over the extent of a given angle so that an unreasonable force is imposed on the gear, the flexure of the shaft can allow to release the subject to a engagement of the gear, thereby preventing the gear from being damaged or collapsing.

We claim:

1. In a timepiece having a housing, and at least one decorative element, means mounting each at least one decorative element for rotation relative to the housing: a rotary member supporting the decorative element and rotatably mounted on a shaft connected to the housing, a stationary gear mounted on the shaft, a drive motor mounted on the rotary member for rotation therewith, and means for engaging the drive motor with the stationary gear to effect rotation of the decorative element.

2. The timepiece according to claim 1, wherein the means for engaging comprises a drive gear driven by the motor, a resiliently flexible shaft mounted on the rotary member and a pinion mounted for rotation on said flexible shaft and engaged with the drive gear and the stationary gear to effect rotation of the rotary member in response to a driving force by the motor, wherein the flexible shaft is operative to undergo angular displacement in response to an excessive force between the pinion and the stationary gear to effect disengagement thereof.

3. The timepiece according to claim 2, wherein the pinion and the stationary gear have engageable teeth thereon, and wherein the teeth are rounded on outer ends thereof.

4. The timepiece according to claim 1, further comprising means for restricting the rotation of the rotary member comprising at least one engaging member on the rotary member and stopping means disposed on the housing and engageable with the at least one engaging member to prevent further rotation.

5. The timepiece according to claim 4, wherein the stopping means comprises damping means for damping the rotational movement of the rotary member upon the engagement of the at least one engaging member and the stopping means.

6. The timepiece according to claim 1, further comprising means for regulating the rotation of the rotary member comprising means forming a cam surface on one surface of the stationary gear and switching means electrically connected to the motor and rotatable with the rotary member and having cam following actuators engaged with the cam surface for controlling the motor in response to the angular position of the actuators relative to the stationary gear.

* * * * *